US006505898B1

(12) United States Patent
Buchanan et al.

(10) Patent No.: US 6,505,898 B1
(45) Date of Patent: Jan. 14, 2003

(54) ENTERTAINMENT CENTER WINGS

(76) Inventors: Larry Michael Buchanan, 10600 127th Place North, Largo, FL (US) 33773; Sharon Kay Buchanan, 10600 127th Place North, Largo, FL (US) 33773

( * ) Notice: Subject to any disclaimer, the term of this patent is extended or adjusted under 35 U.S.C. 154(b) by 72 days.

(21) Appl. No.: 09/658,360

(22) Filed: Sep. 8, 2000

(51) Int. Cl.[7] ..... A47B 81/06
(52) U.S. Cl. ..... 312/7.2; 312/213
(58) Field of Search ..... 312/7.2, 223.3, 312/210, 213, 257.1, 326, 329

(56) References Cited

U.S. PATENT DOCUMENTS 2,806,754 A * 9/1957 Abeles et al. ..... 312/210 X
3,926,487 A * 12/1975 Reyes ..... 312/213 X
4,669,790 A * 6/1987 Briggs ..... 312/223.3
5,125,612 A * 6/1992 McNeal ..... 312/7.2 X
5,303,057 A * 4/1994 Davidow et al. ..... 312/7.2 X

* cited by examiner

*Primary Examiner*—James O. Hansen

(57) ABSTRACT

An entertainment center system comprises a cabinet having a planar bottom, a top panel, side panels, an open back with vertical edges, a front formed of an opening extending there through with horizontal shelving there within supporting electronic entertainment equipment. A pair of similarly configured generally rectangular pivotal plates each have a front face, a rear face, an interior edge and a parallel exterior edge. Hinges are coupled to the rear face of each pivotal plate adjacent to the interior edge and are also coupled to an associated vertical edge of the cabinet.

9 Claims, 4 Drawing Sheets

ENTERTAINMENT CENTER WINGS

BACKGROUND OF THE INVENTION

1. Field of the Invention

The present invention relates to entertainment center wings and more particularly pertains to obscuring unsightly wires while abating overheating and facilitating size adjustments.

2. Description of the Prior Art

The use of cabinets of known designs and configurations is known in the prior art. More specifically, cabinets of known designs and configurations previously devised and utilized for the purpose of abating the unsightliness of electrical wires are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,669,790 to Briggs discloses a multipurpose cabinet and U.S. Pat. No. 5,125,612 to McNeal discloses a video screen bracket.

While these devices fulfill their respective, particular objectives and requirements, the aforementioned patents do not describe entertainment center wings that allow obscuring unsightly wires while abating overheating and facilitating size adjustments.

In this respect, the entertainment center wings according to the present invention substantially departs from the conventional concepts and designs of the prior art, and in doing so provides an apparatus primarily developed for the purpose of obscuring unsightly wires while abating overheating and facilitating size adjustments.

Therefore, it can be appreciated that there exists a continuing need for new and improved entertainment center wings which can be used for obscuring unsightly wires while abating overheating and facilitating size adjustments. In this regard, the present invention substantially fulfills this need.

SUMMARY OF THE INVENTION

In view of the foregoing disadvantages inherent in the known types of cabinets of known designs and configurations now present in the prior art, the present invention provides an improved entertainment center system. As such, the general purpose of the present invention, which will be described subsequently in greater detail, is to provide new and improved entertainment center wings and method which has all the advantages of the prior art and none of the disadvantages.

To attain this, the present invention essentially comprises a cabinet. The cabinet is formed in a generally rectilinear configuration. The cabinet has a generally horizontal planar bottom and a generally horizontal top panel. The cabinet also has parallel generally vertical side panels between the bottom and the top panel. Additionally, the cabinet has an open back. The open back has a small peripheral surface including vertical edges adjacent to the side panels. The cabinet also has a front formed of a plurality of openable doors. An opening extends through the cabinet from the front to the back. Horizontal shelving is provided within the opening. The shelving supports electronic entertainment equipment including a television set and the like. The equipment has electrical wires. Plugs extend rearwardly from the electrical wires for coupling to a source of electrical potential. A volumetric space is formed by a vertical wall located rearwardly by a predetermined distance from the back of the cabinet. The space is also bounded vertically by the bottom and top panel and horizontally by the side panels of the cabinet. The wall has an electric outlet for receiving the plugs. Next provided is a pair of similarly configured pivotal plates. Each of the plates is in a generally rectangular configuration. Each of the plates has a front face and a rear face. Each of the plates also has a top edge and a parallel bottom edge with a length essentially equal to the predetermined distance from the back of the cabinet. Each of the plates also has an interior edge and a parallel exterior edge with a height essentially equal to the height of the side panels. Each of the panels is planar. Each of the panels is also formed with three elongated vertical apertures sized to constitute more than 50 percent of the area of each plate. A mesh fabric within the apertures allows cooling are to flow through the apertures but obscures the viewing of the wires within the volumetric space. Lastly provided is a pair of hinges. The hinges are coupled to the rear face of each pivotal plate adjacent to the interior edge. The hinges are also coupled to an associated vertical edge of the cabinet. The hinges allow each panel to pivot between a first position parallel with and in proximity to the back of the cabinet and a second position essentially parallel with the side panels and between the side panels and the wall. In this manner the wires located within the volumetric space are obscured.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved entertainment center system which has all of the advantages of the prior art cabinets of known designs and configurations and none of the disadvantages.

It is another object of the present invention to provide a new and improved entertainment center system which may be easily and efficiently manufactured and marketed.

It is further object of the present invention to provide a new and improved entertainment center system which is of durable and reliable constructions.

An even further object of the present invention is to provide a new and improved entertainment center system which is susceptible of a low cost of manufacture with regard to both materials and labor, and which accordingly is then susceptible of low prices of sale to the consuming public, thereby making such entertainment center system economically available to the buying public.

Even still another object of the present invention is to provide entertainment center wings for obscuring unsightly wires while abating overheating and facilitating size adjustments.

Lastly, it is an object of the present invention to provide a new and improved entertainment center system comprising a cabinet having a planar bottom, a top panel, side panels, an open back with vertical edges, a front formed of an opening extending there through with horizontal shelving there within supporting electronic entertainment equipment. A pair of similarly configured generally rectangular pivotal plates each have a front face, a rear face, an interior edge and a parallel exterior edge. Hinges are coupled to the rear face of each pivotal plate adjacent to the interior edge and are also coupled to an associated vertical edge of the cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
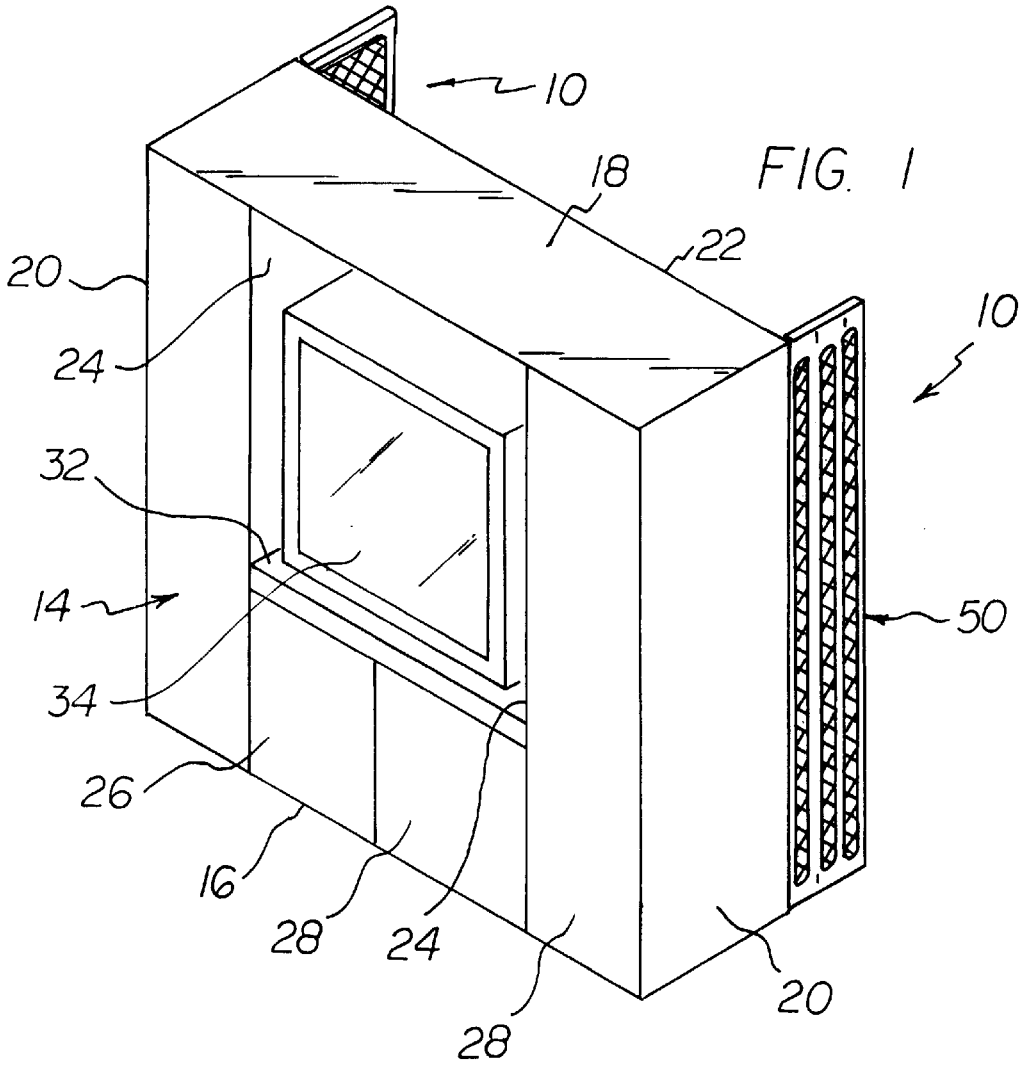
FIG. 1 is perspective view of the entertainment center wings constructed in accordance with the principles of the present invention.
Figure 2:
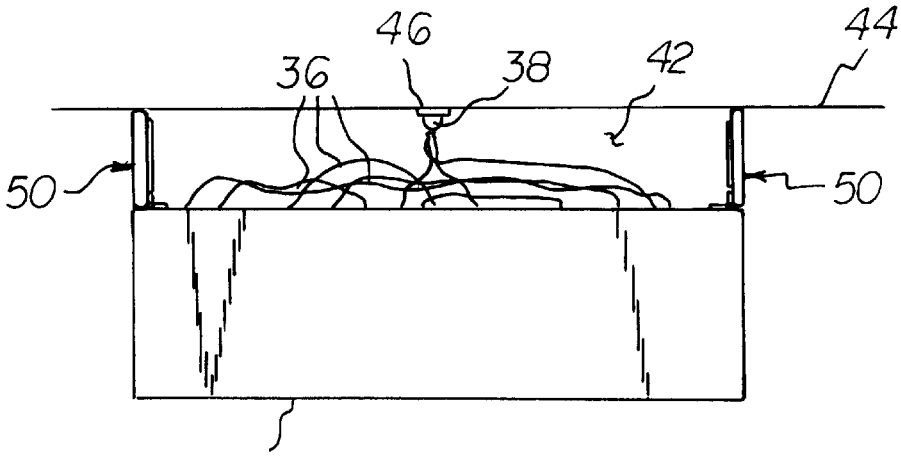
FIG. 2 is a top elevational view of the system shown in FIG. 1.
Figure 3:
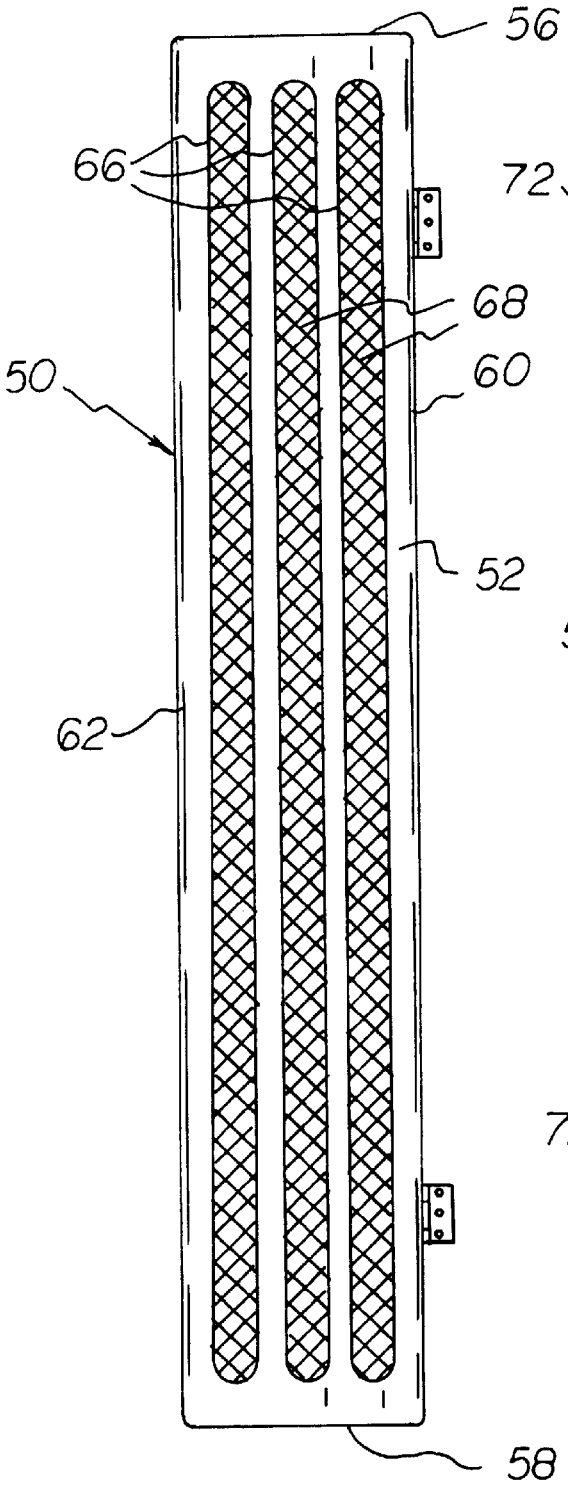
FIG. 3 is a front elevational view of one of the pivotal plates shown in FIG. 1.

With reference now to the drawings, and in particular to FIG. 1 thereof, the preferred embodiment of the new and improved entertainment center system embodying the principles and concepts of the present invention and generally designated by the reference numeral 10 will be described.

The present invention, the entertainment center system with wings 10 is comprised of a plurality of components. Such components in their broadest context include a cabinet, a pair of similarly configured plates, and a pair of hinges. Such components are individually configured and correlated with respect to each other so as to attain the desired objective.

First provided is a cabinet 14. The cabinet is formed in a generally rectilinear configuration. The cabinet has a generally horizontal planar bottom 16 and a generally horizontal top panel 18. The cabinet also has parallel generally vertical side panels 20 between the bottom and the top panel. Additionally, the cabinet has an open back 22. The open back has a small peripheral surface including vertical edges 24 adjacent to the side panels. The cabinet also has a front 26 formed of a plurality of openable doors 28. An opening 30 extends through the cabinet from the front to the back. Horizontal shelving 32 is provided within the opening. The shelving supports electronic entertainment equipment 34 including a television set and the like. The equipment has electrical wires 36. Plugs 38 extend rearwardly from the electrical wires for coupling to a source of electrical potential.

A volumetric space 42 is formed by a vertical wall 44 located rearwardly by a predetermined distance from the back of the cabinet. The space is also bounded vertically by the bottom and top panel and horizontally by the side panels of the cabinet. The wall has an electric outlet 46 for receiving the plugs.

Next provided is a pair of similarly configured pivotal plates 50. Each of the plates is in a generally rectangular configuration. Each of the plates has a front face 52 and a rear face 54. Each of the plates also has a top edge 56 and a parallel bottom edge 58 with a length essentially equal to the predetermined distance from the back of the cabinet. Each of the plates also has an interior edge 60 and a parallel exterior edge 62 with a height essentially equal to the height of the side panels. Each of the panels is curved planar. Each of the panels is also formed with three elongated vertical apertures 66 sized to constitute more than 50 percent of the area of each plate. A mesh fabric 68 within the apertures allows cooling are to flow through the apertures but obscures the viewing of the wires within the volumetric space.

Lastly provided are a pair of hinges 72. The hinges are coupled to the rear face of each pivotal plate adjacent to the interior edge. The hinges are also coupled to an associated vertical edge of the cabinet. The hinges allow each panel to pivot between a first position parallel with and in proximity to the back of the cabinet and a second position essentially parallel with the side panels and between the side panels and the wall. In this manner the wires located within the volumetric space are obscured.

Figure 4:
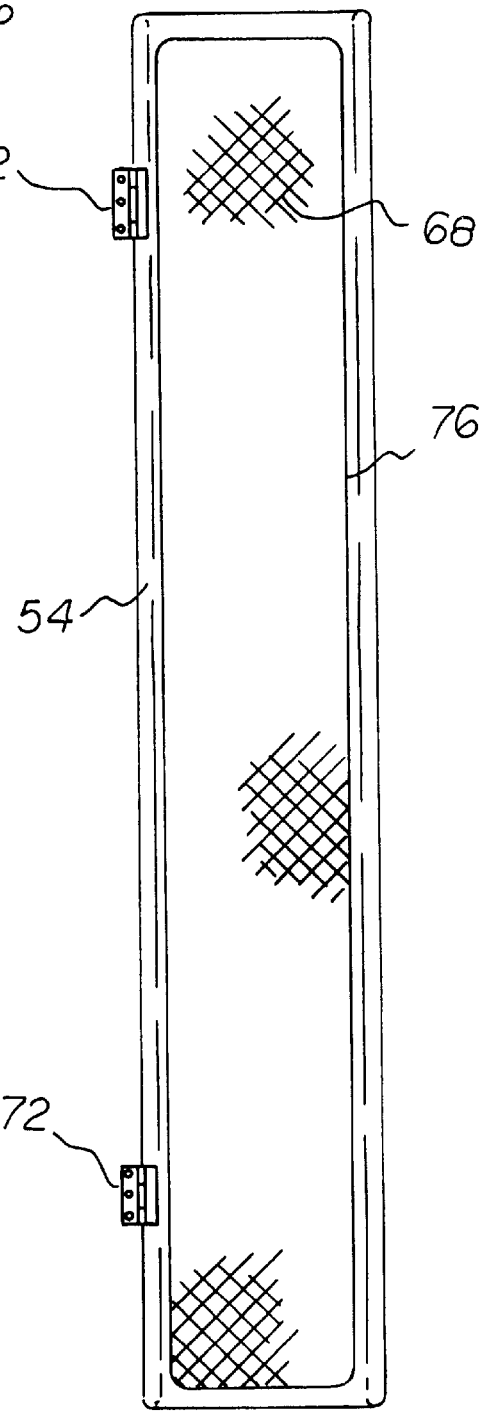
FIG. 4 is a front elevational view of a pivotal plate constructed in accordance with an alternate embodiment.

FIG. 4 shows another suggested alternate configuration of the apertures 76. Each aperture is of an enlarged size.

Figure 5:
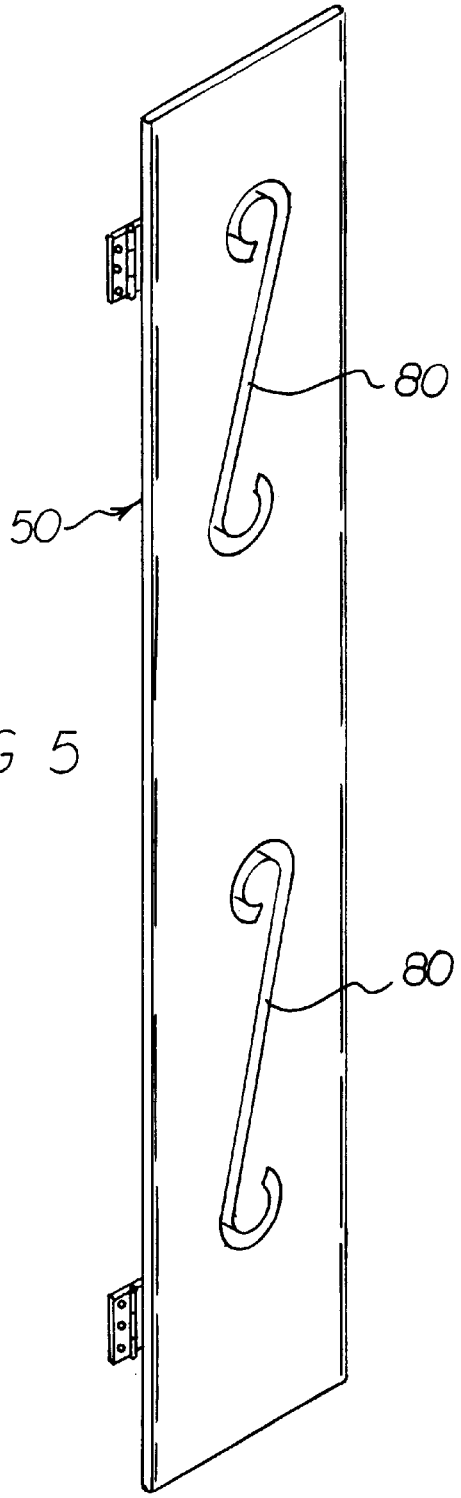
FIG. 5 is a front elevational view of another pivotal plate constructed in accordance with another alternate embodiment.

In other alternate embodiments, the apertures may be of varying sizes and shapes. As shown in FIG. 5, an alternate embodiment of the invention configures the apertures 80 formed in a scroll-like configuration.

In these alternate embodiments of the invention, the panels may be of variable sizes and shapes.

Figure 6:
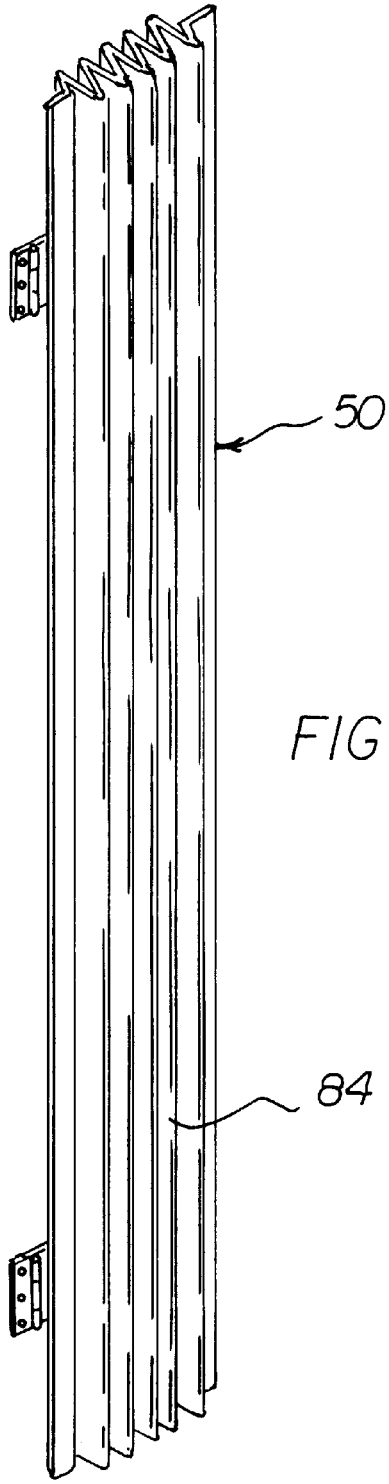
FIG. 6 is a front elevational view of yet another pivotal plate constructed in accordance with yet another alternate embodiment.

In another alternate embodiment as shown in FIG. 6, the pivotal panels may be formed as stretchable accordion-like panels 84 to accommodate varying distances between the cabinet and the wall.

Figure 7:
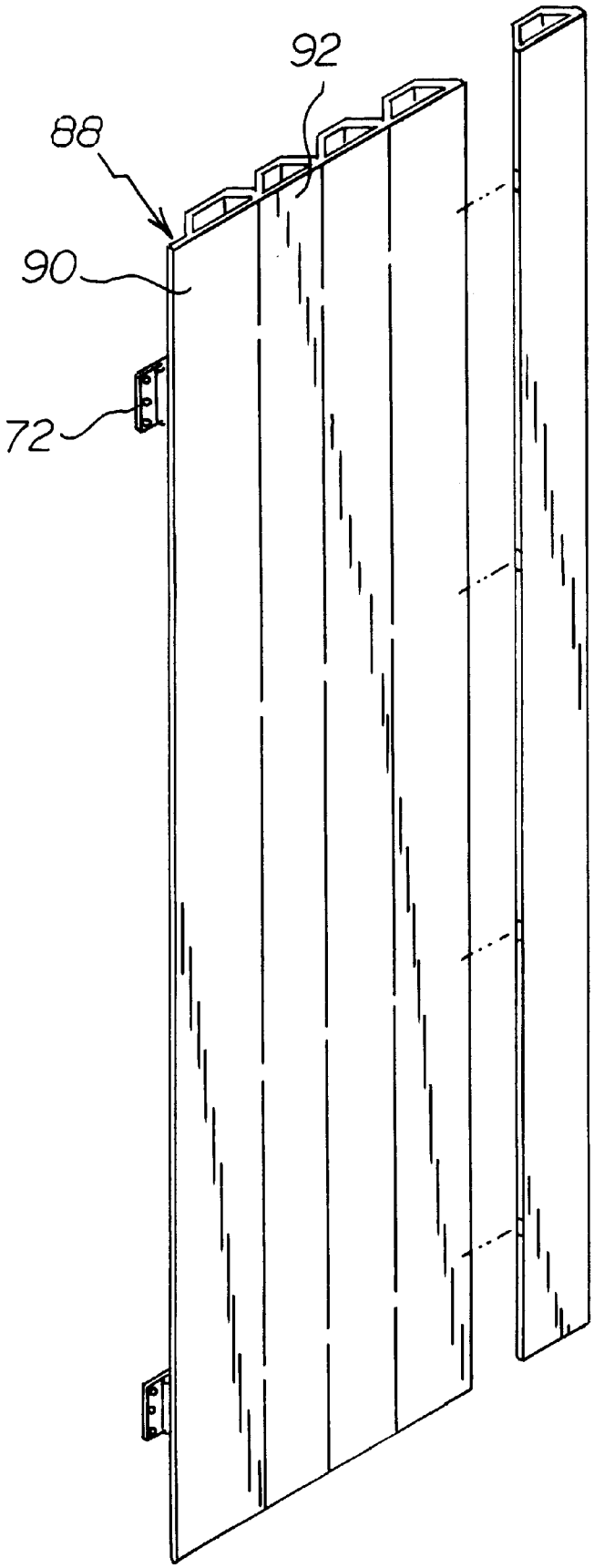
FIG. 7 is a front elevational view of another pivotal plate constructed in accordance with a final alternate embodiment.

In yet another embodiment of the invention the pivotal panels 88 may be formed with laterally spaced thick sections 90 and thin sections 92 extending vertically. In this embodiment, the sections are adapted to be easily broken apart at the thin sections as needed to accommodate varying distances between the cabinet and the wall. Note FIG. 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An entertainment center system with wings for obscuring unsightly wires while abating overheating and facilitating size adjustments comprising, in combination:

a cabinet in a generally rectilinear configuration having a generally horizontal planar bottom and a generally horizontal top panel and having parallel generally vertical side panels between the bottom and the top panel, the cabinet also having an open back with a small peripheral surface including vertical edges adjacent to the side panels, the cabinet also having a front formed of a plurality of openable doors and an opening extending there through from the front to the back with horizontal shelving there within supporting electronic entertainment equipment including a television set, the equipment having electrical wires with plugs extending rearwardly there from for coupling to a source of electrical potential;

a volumetric space formed by a vertical wall located rearwardly by a predetermined distance from the back of the cabinet and bounded vertically by the bottom and top panel and horizontally by the side panels of the cabinet, the wall having an electric outlet for receiving the plugs;

a pair of similarly configured pivotal plates, each of the plates being in a generally rectangular configuration with a front face and a rear face and having a top edge and a parallel bottom edge with a length essentially equal to the predetermined distance, each of the plates also having an interior edge and a parallel exterior edge with a height essentially equal to the height of the side panels, each of the panels also being formed with three elongated vertical apertures sized to constitute more than 50 percent of the area of each plate with a mesh fabric within the apertures to allow the flow of cooling air there through but to obscure the viewing of the wires within the volumetric space; and a pair of hinges coupled to the rear face of each pivotal plate adjacent to the interior edge and also coupled to an associated vertical edge of the cabinet to thereby allow each panel to pivot between a first position parallel with and in proximity to the back of the cabinet and a second position essentially parallel with the side panels and between the side panels and the wall to thereby obscure the wires located within the volumetric space.

2. An entertainment center system with wings for obscuring unsightly wires while abating overheating and facilitating size adjustments comprising, in combination:

a cabinet in a generally rectilinear configuration having a generally horizontal planar bottom and a generally horizontal top panel and having parallel generally vertical side panels between the bottom and the top panel, the cabinet also having an open back with a small peripheral surface including vertical edges adjacent to the side panels, the cabinet also having a front formed of a plurality of openable doors and an opening extending there through from the front to the back with horizontal shelving there within supporting electronic entertainment equipment including a television set, the equipment having electrical wires with plugs extending rearwardly there from for coupling to a source of electrical potential;

a volumetric space formed by a vertical wall located rearwardly by a predetermined distance from the back of the cabinet and bounded vertically by the bottom and top panel and horizontally by the side panels of the cabinet, the wall having an electric outlet for receiving the plugs;

a pair of similarly configured pivotal plates, each of the plates being in a generally rectangular configuration with a front face and a rear face and having a top edge and a parallel bottom edge with a length essentially equal to the predetermined distance, each of the plates also having an interior edge and a parallel exterior edge with a height essentially equal to the height of the side panels; and a pair of hinges coupled to the rear face of each pivotal plate adjacent to the interior edge and also coupled to an associated vertical edge of the cabinet to thereby allow each panel to pivot between a first position parallel with and in proximity to the back of the cabinet and a second position essentially parallel with the side panels and between the side panels and the wall to thereby obscure the wires located within the volumetric space.

3. An entertainment center system with wings for obscuring unsightly wires while abating overheating and facilitating size adjustments as set forth in claim 2 wherein each pivotal plate is of a fixed size.

4. An entertainment center system with wings for obscuring unsightly wires while abating overheating and facilitating size adjustments as set forth in claim 3 wherein each pivotal plate has at least one aperture there through.

5. An entertainment center system with wings for obscuring unsightly wires while abating overheating and facilitating size adjustments as set forth in claim 4 and further comprising a mesh located within each aperture.

6. An entertainment center system with wings for obscuring unsightly wires while abating overheating and facilitating size adjustments as set forth in claim 4 wherein each aperture is in a scroll shaped configuration.

7. An entertainment center system with wings for obscuring unsightly wires while abating overheating and facilitating size adjustments as set forth in claim 2 wherein each pivotal plate is of a variable size.

8. An entertainment center system with wings for obscuring unsightly wires while abating overheating and facilitating size adjustments as set forth in claim 7 wherein each pivotal plate is in an accordion like configuration to accommodate varying distances between the cabinet and an adjacent wall.

9. An entertainment center system with wings for obscuring unsightly wires while abating overheating and facilitating size adjustments as set forth in claim 7 wherein each pivotal plate is formed with laterally spaced thick sections and thin sections extending vertically adapted to be easily broken apart to accommodate varying distances between the cabinet and an adjacent wall.

* * * * *